US005769175A

United States Patent [19]

Matthias

[11] Patent Number: 5,769,175

[45] Date of Patent: Jun. 23, 1998

[54] CUTTER ASSEMBLIES FOR ROTARY DRILL BITS

[75] Inventor: Terry R. Matthias, Longlevens, United Kingdom

[73] Assignee: Camco Drilling Group Limited, Stonehouse, United Kingdom

[21] Appl. No.: 618,433

[22] Filed: Mar. 15, 1996

[30] Foreign Application Priority Data

Mar. 23, 1995 [GB] United Kingdom ..... 9505922

[51] Int. Cl.[6] ..... E21B 10/46

[52] U.S. Cl. ..... 175/420.2; 175/432

[58] Field of Search ..... 175/420.2, 428, 175/432, 434

[56] References Cited

U.S. PATENT DOCUMENTS

| | | | |
|---|---|---|---|
| Re. 32,036 | 11/1985 | Dennis . | |
| 4,109,737 | 8/1978 | Bovenkerk . | |
| 4,679,639 | 7/1987 | Barr et al. | 175/432 |
| 4,987,800 | 1/1991 | Gasan et al. . | |
| 5,016,718 | 5/1991 | Tandberg . | |
| 5,435,403 | 7/1995 | Tibbits | 175/432 |
| 5,566,779 | 10/1996 | Dennis | 175/434 X |
| 5,590,728 | 1/1997 | Matthias et al. | 175/434 X |

FOREIGN PATENT DOCUMENTS

| | | |
|---|---|---|
| 0145423 | 6/1985 | European Pat. Off. . |
| 2188354 | 9/1987 | United Kingdom . |
| 2276645 | 10/1994 | United Kingdom . |
| 2276646 | 10/1994 | United Kingdom . |

*Primary Examiner*—William P. Neuder

[57] ABSTRACT

A cutter for a rotary drill bit comprises a cutting table of superhard material bonded to a less hard substrate, the cutting table having a front face and a peripheral edge at least a part of which defines a convexly curved cutting region. The substrate includes a portion which increases in lateral extent beyond the curved cutting region of the peripheral edge of the cutting table as it extends rearwardly . The rearward extent of the outer surface of said portion varies around the periphery of the cutting table, from a maximum adjacent the cutting region to a minimum diametrically opposite the cutting region. This renders the cutter more resistant to impact loads in the cutting region while, at the same time, allowing the opposite side of the cutter to be firmly mounted in a socket in the body of the drill bit.

17 Claims, 2 Drawing Sheets

FIG 4
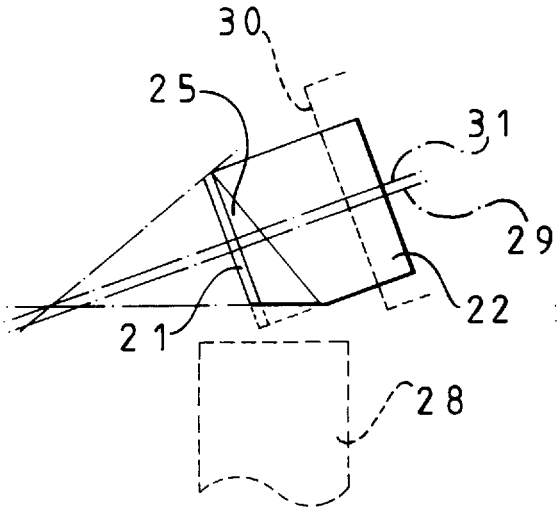
FIG 5
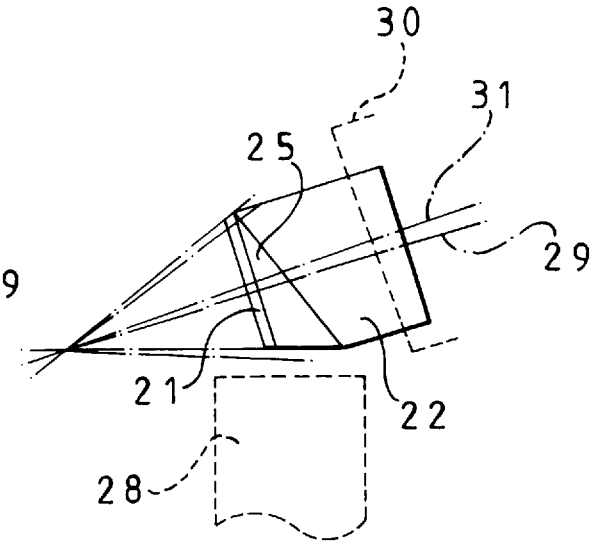
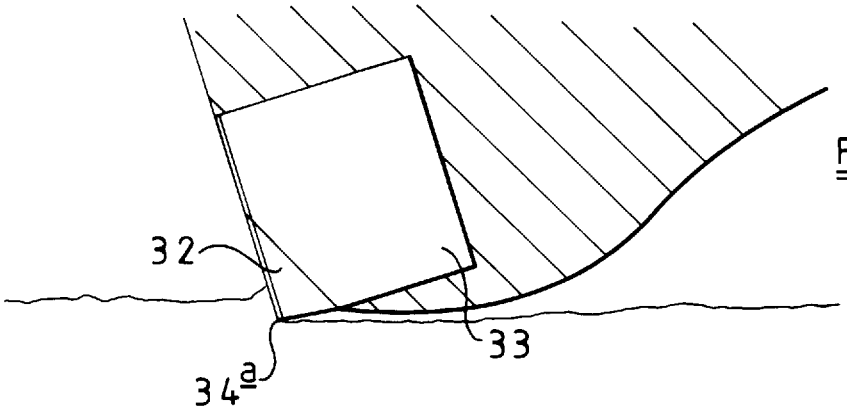
FIG 6
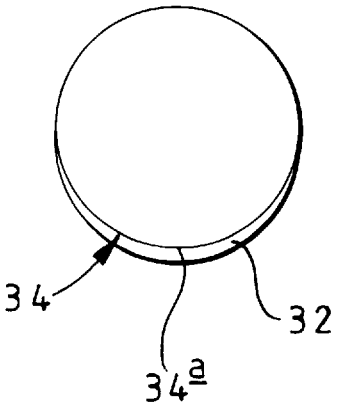
FIG 7

CUTTER ASSEMBLIES FOR ROTARY DRILL BITS

BACKGROUND OF THE INVENTION

1. Field of the Invention

The invention relates to cutters for drag-type rotary drill bits for use in drilling or coring holes in subsurface formations. Such rotary drill bits comprise a bit body having a shank for connection to a drill string, a plurality of cutters mounted at the surface of the bit body, and a passage in the bit body for supplying drilling fluid to the surface of the bit for cleaning and/or cooling the cutters. Each cutter comprises a preform cutting element mounted in a socket on the bit body or on a carrier which is then mounted in a socket on the bit body.

2. Setting of the Invention

One common form of preform cutting element comprises a tablet, for example circular, having a thin cutting table of superhard material, such as polycrystalline diamond, bonded to a thicker substrate of less hard material, such as tungsten carbide. The thickness of the substrate may be such that the substrate itself forms a stud which may be directly mounted in a socket in the bit body. Alternatively, the cutting element may be mounted on a carrier, for example by the brazing process known as "LS bonding". The carrier is then mounted in a socket in the bit body.

As is well known the bit body itself may be machined from metal, usually steel, or molded using a powder metallurgy process.

It is known that cutters of this type may be susceptible to impact damage, due for example to heavy impact of the drill bit on the borehole bottom while being introduced into the borehole, or as a result of impact on harder occlusions in the formation being drilled. Such impact damage is likely to be increased as a result of the stress concentration which can occur at the sharp cutting edge between the front cutting face of the superhard layer and the peripheral edge of the cutting layer and substrate. Impact damage is particularly likely to occur when the cutters are new and before a wear flat has been formed on the superhard cutting table and substrate at the cutting edge.

Attempts have been made to reduce this susceptibility to impact damage by pre-beveling or pre-chamfering the peripheral edge of the superhard cutting table, and such arrangements are described in U.S. Pat. Nos. Re 32,036, 4,109,737, 4,987,800 and 5,016,718.

British Patent Specification No. 2276645 discloses a further development of this concept in which the substrate is also beveled so as to increase in lateral extent beyond the cutting edge as it extends rearwardly from the superhard cutting table. In a preferred arrangement the cutting table and substrate are both circular in cross-section and coaxial. The portion of the substrate immediately adjacent the cutting table is frusto-conical in shape and tapers outwardly from the periphery of the cutting table to the cylindrical portion of the remainder of the substrate, which is of greater diameter than the cutting table. The frusto-conical portion of the substrate is coaxial with the cutting table and substrate so that the rearward extent of its outer surface is constant around the periphery of the cutting table.

It is believed that, in such prior art arrangement, the provision of the frusto-conical portion of substrate behind the cutting table may improve the resistance of the cutter to impact loads in some directions. However, such arrangements may suffer from significant disadvantages.

As previously mentioned, the substrate, including the cylindrical carrier on which it is mounted if such carrier is provided, is received within an appropriately shaped part-cylindrical socket in the bit body, and is usually secured within the socket by brazing. In order to achieve exposure of the cutting table above the surface of the portion of the bit body on which it is mounted, the part-cylindrical socket normally embraces only a portion of the periphery of the substrate and carrier, leaving a significant portion exposed. It is currently considered that increasing the exposure of cutters above the bit body increases the rate of penetration of the drill bit, but increasing the exposure tends to decrease the area of the surface of the cutter which is brazed within the socket. In order for the cutter to be securely retained, therefore, it is important that as much of the available surface area as possible is strongly brazed within the socket.

In the above-mentioned British Patent Specification No. 2276645, the socket in which the cutter is received is shown as apparently having a frusto-conical mouth portion which closely engages the tapered portion of the substrate or carrier. However, it would be technically difficult to form a socket of such shape, particularly in a machined steel bit body, and also it may be impossible to insert the cutter into such a socket, particularly if the socket is to embrace more than half the periphery of the cutter (which is desirable for strong retention). In practice, therefore, the socket will normally be cylindrical and of constant cross-section corresponding to the larger diameter portion of the carrier or substrate. Consequently, once the cutter is located in the socket there is a part annular gap left between the peripheral wall of the socket and the frusto-conical portion of the substrate. In practice, this gap will usually be filled with braze material.

The result of this is that the region of the frusto-conical portion of the substrate which is opposite the cutting edge may not be adequately attached to, or supported by, the surrounding bit body with the result that the heavy stresses imparted to the cutter in use may result in fracture or detachment of the cutter from the bit body. Thus, although the provision of a frusto-conical portion of substrate adjacent the cutting table may reduce the concentration of stress at the cutting edge, it may in fact tend to weaken the cutter, and its attachment to the bit body, in other respects. The present invention sets out to provide a novel form of cutter where this disadvantage may be overcome.

SUMMARY OF THE INVENTION

According to the invention there is provided a cutter for a rotary drill bit comprising a cutting table of superhard material bonded to a less hard substrate, the cutting table having a front face and a peripheral edge at least a part of which defines a convexly curved cutting region, and the substrate including at least a portion thereof which increases in lateral extent beyond at least said curved cutting region of the peripheral edge of the cutting table as it extends rearwardly therefrom, the rearward extent of the outer surface of said portion varying around the periphery of the cutting table. The substrate may include a further portion which does not increase in lateral extent beyond the peripheral edge of the cutting table as it extends rearwardly thereof.

Preferably said outer surface of the laterally increased portion of the substrate has a rearward extent which is a maximum adjacent a part of said convexly curved cutting region of the cutting table, the rearward extent decreasing, preferably smoothly and substantially linearly, as the substrate extends away from said part of cutting region to a second region of the peripheral edge of the cutting table.

In use, the cutting element is so orientated on the drill bit that its convexly curved cutting region, where the surface of said laterally increased portion is a maximum, engages the earthen formation being drilled, and in a region where the substrate is attached to the drill bit the rearward extent of said laterally increased portion is a minimum, for example is zero. This allows the peripheral surface of the substrate to absorb impact loads in the vicinity of the cutting edge, while at the same time not unduly reducing the area of contact between the substrate and its socket in regions away from the cutting edge. This region of minimum rearward extent is preferably diametrically opposite said part of the cutting region.

In any of the above arrangements the substrate may comprise a substantially unitary body of said less hard material to which the cutting table is bonded, or it may comprise a first portion to which the cutting table is bonded, said first portion being in turn bonded to a second, carrier portion. The substrate may be of generally circular cross-section and generally cylindrical in form, except for said portion of increasing lateral extent. However, the invention also includes within its scope arrangements where the cutting table and substrate are non-circular and/or non-cylindrical in shape.

In any of the above arrangements said portion of the substrate of increasing lateral extent may be generally frusto-conical in shape. In cases where the substrate is generally cylindrical the variation in rearward extent of the outer surface of the frusto-conical portion may be effected by the axis of the frusto-conical portion being offset from the central axis of the rest of the substrate. For example, the axis of the frusto-conical portion may be parallel to, and spaced from, the axis of the rest of the substrate, or may be inclined with respect to said axis. Preferably the angle of the frusto-conical portion of the substrate, and the offset of its axis, are so selected that the rearward extent of the outer surface of said frusto-conical portion is substantially zero in one region of the peripheral edge of the cutting table.

In any of the arrangements according to the invention the peripheral edge of the cutting table may be chamfered, and preferably the chamfered peripheral edge of the cutting table blends substantially smoothly with the adjacent surface of the laterally increased portion of the substrate.

The invention includes within its cope a method of forming a cutter for a rotary drill bit, the method comprising forming an intermediate structure comprising a cutting table of superhard material, having a front face and a peripheral edge, bonded to a less hard substrate, and then removing material from the intermediate structure, adjacent the cutting table, to form on the cutting table a convexly curved cutting region, and to form on the substrate at least a portion thereof which increases in lateral extent beyond at least the curved cutting region of the peripheral edge of the cutting table as it extends rearwardly therefrom, the rearward extent of the outer surface of said portion varying around the periphery of the cutting table.

This material may, for example, be removed from the intermediate structure by rotating the intermediate structure relative to a material removing device about a second axis so as to form said convexly curved cutting region on said peripheral edge of the cutting table and to form on said substrate a frusto-conical surface adjacent said cutting region, said second axis being offset with respect to said longitudinal axis of the substrate so as to vary the extent to which the outer surface of said frusto-conical surface extends rearwardly of the peripheral edge of the cutting table.

BRIEF DESCRIPTION OF THE DRAWINGS

FIGS. 4 and 5 are diagrammatic representations of cutters according to the invention, showing methods of manufacture.

FIG. 6 is a similar view to FIG. 1 of an alternative form of cutter according to the invention.

FIG. 7 is a front view of the cutter of FIG. 6.

DETAILED DESCRIPTION OF THE PREFERRED EMBODIMENTS

Figure 1:
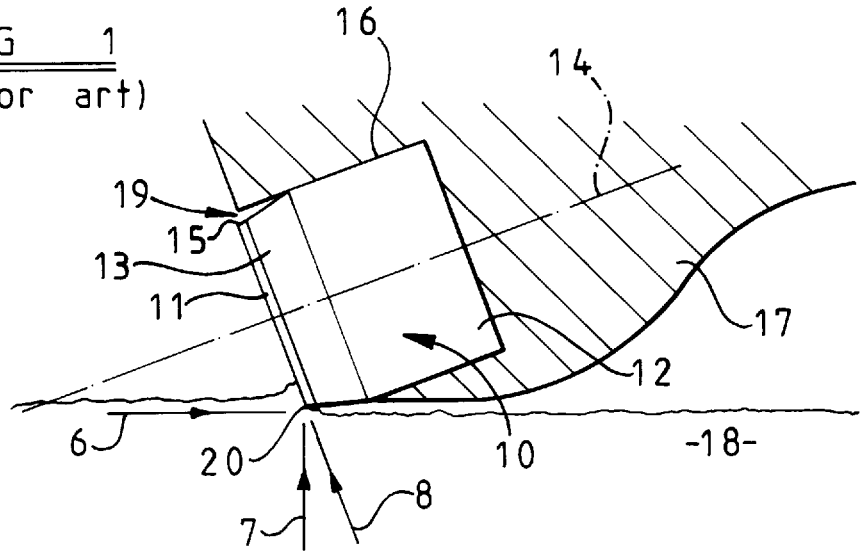
FIG 1 (Prior art)
FIG. 1 is a diagrammatic part side elevation and part section of a prior art cutter mounted on the body of a drill bit.

Referring to FIG. 1, the prior art cutter 10 comprises a circular thin cutting table 11 of polycrystalline diamond bonded, in a high pressure, high temperature press to a substrate 12 of tungsten carbide. The substrate 12 is cylindrical and of circular cross-section and is coaxial with the cutting table 11. The substrate 12 may comprise a unitary body of tungsten carbide the whole of which is bonded to the polycrystalline diamond cutting table 11 in the press. Alternatively, the substrate may comprise a thinner portion of tungsten carbide which is bonded to the polycrystalline diamond cutting table 11 in the press to form a cutting element, the tungsten carbide layer of the cutting element then being bonded to a separately formed cylindrical carrier of tungsten carbide, for example by brazing. As previously mentioned, the term "substrate" will be used to refer to the body of material behind the polycrystalline diamond cutting table 11 in both types of construction.

In the prior art arrangement of FIG. 1, the portion 13 of the substrate 12 immediately to the rear of the cutting table 11 is frusto-conical in shape, the half-angle of the cone being, for example, about 10. The central axis of the frusto-conical portion 13 is coincident with the longitudinal axis 14 of the cutter so that the substrate has a constant 10 bevel around the whole of its periphery. The peripheral edge 15 of the cutting table 11 is similarly beveled so as to blend smoothly with the frusto-conical portion 13. As may be seen from FIG. 1, therefore, the rearward extent of the outer surface of the frusto-conical portion 13, with respect to the cutting table 11, is constant around the whole periphery of the cutting table.

Impact loads can be imposed on the cutting edge 20 of the cutter in a number of directions, and the principal directions are indicated by arrows in FIG. 1. Thus, impact loads can be aligned along the drag direction, parallel to the surface of the formation 18, as indicated by the arrow 6; in the weight-on-bit direction 7, generally at right angles to the surface of the formation; and, due to bit whirl and backwards rotation, typically in a direction indicated by the arrow 8 in FIG. 1. Any total impact load is therefore likely to be aligned anywhere in the angle between the arrows 6 and 8 and generally, therefore, the impact load can be resolved into two components in the drag direction 6 and weight-on-bit direction 7 respectively.

The prior art cutter of the kind illustrated in FIG. 1 can provide benefit in respect of loads predominantly in, or resolvable along, the drag direction 6. However, such arrangement may be detrimental in respect of impact loads in the weight-on-bit direction 7 or whirl direction 8, the weight-on-bit direction typically providing the highest loads. The reasons for this will now be explained.

A substantial proportion of the substrate 12 is received within a cylindrical socket 16 in a blade 17 formed on the bit body, such blades usually extending outwardly away from the central axis of rotation of the bit. In order for the cutter to be securely attached to the bit body, it is important that as much as possible of the portion of the substrate which is embraced by the socket is strongly brazed to the walls of the socket.

However, as a result of providing the frusto-conical portion 13, the outer surface of this portion which lies within the socket 16 does not contact the wall of the socket but leaves a part-annular gap between this portion of the substrate and the wall of the socket, as indicated at 19 in FIG. 1. The cutter will normally be brazed into the socket 16 and in this case the gap 19 will be filled with braze material. As is well known, the strength of a braze joint is related to the thickness of the braze material in the joint, and once an optimum thickness is exceeded the strength of the joint falls rapidly. In a braze joint of the kind used to secure a cutter within a socket, braze joint strength is typically at a maximum at a thickness of 10–40 am. However, in the prior art arrangement the majority of the triangular gap 19 surrounding the frusto-conical portion 13 of the substrate will be filled with braze material which is much thicker than the optimum and may for example be as great as 350 am in thickness. The braze joint in the gap 19 will therefore be weak compared with the braze joint between the rest of the substrate 12 and the socket 16. Not only does this increase the risk of the cutter becoming detached from the socket under heavy stresses, but it also means that the substrate is less effectively supported by the bit body in the very region, i.e. opposite the cutting edge 20, where adequate support is most needed.

Since the braze material in this region is less rigid than the material forming the socket, especially in the case of matrix-bodied bits, it acts rather like a soft spring and impact loads acting on the cutting edge 20 generally in the weight-on-bit direction 7 or bit whirl direction 8 may therefore have a tendency to lever the cutter out of its socket.

Another disadvantage of a thick braze joint being provided around the exposed cutting face of the cutter is that this increases the tendency for the exposed line of braze material to be eroded by the flow of drilling mud over the cutter, such erosion being particularly common in respect of cutters located in the vicinity of the nozzles which deliver drilling mud to the surface of the drill bit.

Consequently, while the beveled shape of the portion 13 of the substrate may reduce the impact loads on the cutting edge 20 itself, the effect of the bevel may also be to weaken the cutter and its attachment to the bit body in other respects.

Figure 2:
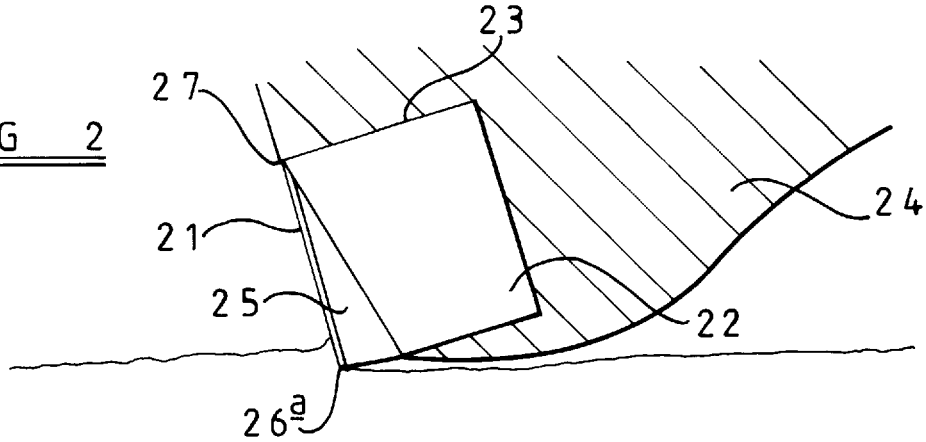
FIG. 2 is a similar view of one form of cutter in accordance with the present invention.
Figure 3:
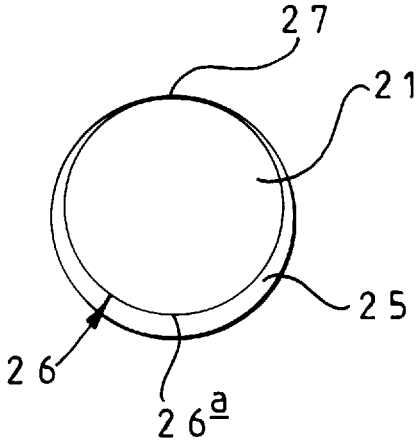
FIG. 3 is a front view of the cutter of FIG. 2.

FIGS. 2 and 3 show an arrangement according to the present invention whereby this disadvantage may be overcome. The basic structure of the cutter of FIGS. 2 and 3 is similar to that of the prior art cutter of FIG. 1 in that it comprises a polycrystalline diamond cutting table 21 bonded to a substrate 22 of circular cross-section which is received in a cylindrical socket 23 in a blade 24 on the bit body.

As in the prior art, the substrate 22 is formed with a frusto-conical portion 25 immediately rearward of the cutting table 21. In accordance with the present invention, however, the outer surface of the portion 25 is not of constant rearward extent as in the prior art arrangement, but its rearward extent varies as it is extends around the periphery of the cutting table 21. Thus, in the preferred arrangement shown, the rearward extent of the outer surface of the portion 25 is a maximum adjacent the central part 26*a* of the convexly curved cutting edge 26 of the cutting table 21 but reduces linearly as it extends away from the central part of the cutting edge, becoming zero at the location 27 diametrically opposite the center of the cutting edge 26.

As a consequence of this construction, the substrate is fully beveled, for example at an angle of 10, adjacent the central part of the cutting edge 26 so as to provide the impact resilience which is believed to result from the provision of such bevel. However, since the rearward extent of the beveled surface reduces in the portions of the substrate which lie within the socket 23, a larger surface area of the cylindrical part of the substrate 22 is in close contact with the walls of the socket 23 resulting in a strong brazed joint. Furthermore, at the location 27 diametrically opposite the cutting edge 26, the whole of the bevel is reduced to zero so that the whole of the cylindrical portion of the substrate is closely adjacent and brazed to the wall of the socket 23, thus providing good support for the substrate in this region.

FIGS. 4 and 5 show two alternative methods for achieving a construction of the kind shown in FIGS. 2 and 3. In the method of FIG. 4 an intermediate structure is first formed comprising the cutting table 21 of circular cross-section bonded to the cylindrical substrate 22 of the same diameter as the cutting table 21. In order to form the frusto-conical portion 25 the intermediate structure is presented to a grinding wheel, indicated diagrammatically at 28, with the longitudinal axis 29 of the intermediate structure arranged at a required angle, for example 10, to the peripheral surface of the grinding wheel 28. However, the intermediate structure is held in a chuck, indicated diagrammatically at 30, for rotation about an axis 31 which is parallel to and spaced from the longitudinal axis 29 of the intermediate structure.

The intermediate structure is then rotated in contact with the grinding wheel 21 so as to form the beveled portion 25. However, the offsetting of the axis of rotation 31 of the intermediate structure from the central longitudinal axis 29 of the structure has the result that the width of the outer surface of the frusto-conical portion 25 varies linearly around the periphery of the structure. The offset distance between the axes is so selected that the minimum rearward extent of the surface of the portion 25 from the cutting table 21 is zero. However, the invention includes within its scope arrangements where the rearward extent is not reduced to zero but where a smaller extent of bevel is formed opposite the maximum extent of bevel.

In the alternative arrangement shown in FIG. 5, the variation in rearward axial extent of the frusto-conical portion 25 is achieved by inclining the axis of rotation 31 of the intermediate structure with respect to the longitudinal axis 29 of the structure. In the arrangement shown the cutting table 21 is flat and planar and is coaxial with the substrate 22. However, the invention includes within its scope arrangements in which the cutting table is not flat but is profiled on its rear face and/or on its front face. For example, the cutting table 21 might be dished or domed or may be formed on its rearward surface with projections with project into the material of the substrate 22.

Also, the substrate need not necessarily be cylindrical in shape or circular in cross-section. Although the beveled portion 25 is preferably frusto-conical, since then it may be readily formed by rotating the intermediate structure in contact with a grinding wheel or other material-removing device, such as an EDM device, the invention includes within its scope arrangements where the surface is not frusto-conical and where the rearward extent of the beveled surface does not vary linearly around the periphery of the cutter. In this case the substrate of the cutter may be appropriately shaped by other known machining or cutting processes, or the cutter may be molded in the required shape in the high pressure, high temperature press.

In the arrangements shown in FIGS. 2, 3 and 5, the beveled portion 25 of the cutter extends around substantially the whole periphery of the substrate, reducing to zero width only at the position 27 directly opposite the center 26*a* of the cutting edge 26. In an alternative arrangement, shown in FIG. 6, the bevel 32 extends around only a portion of the substrate 33, leaving a significant portion of the periphery of the substrate furthest away from the center 34*a* of the cutting edge 34 unbeveled and thus able to be brazed strongly within the cylindrical socket. In this case the bevel may, for example, extend around about half the periphery of the substrate.

Although the method described in relation to FIGS. 4 and 5 is a convenient method of forming a cutter according to the present invention, other forming processes may be employed. For example the cutter may be cut to the desired shape by wire electrical discharge machining or other cutting processes which may allow non-conical, non-symmetrical shapes to be achieved more easily.

Whereas the present invention has been described in particular relation to the drawings attached hereto, it should be understood that other and further modifications, apart from those shown or suggested herein, may be made within the scope and spirit of the present invention.

What is claimed:

1. A cutter for a rotary drill bit comprising a cutting table of superhard material bonded to a less hard substrate, the cutting table having a front face and a peripheral edge at least a part of which defines a convexly curved cutting region, and the substrate including a portion of the surface thereof which is bevelled so as to increase in lateral extent beyond at least said curved cutting region of the peripheral edge of the cutting table as it extends rearwardly therefrom, the rearward extent of said bevelled surface portion of the substrate varying around the periphery of the cutting table.

2. A cutter according to claim 1, wherein the substrate includes a further surface portion which is not bevelled so that it does not increase in lateral extent beyond the peripheral edge of the cutting table as it extends rearwardly thereof.

3. A cutter according to claim 1, wherein said outer surface of the laterally increased portion of the substrate has a rearward extent which is a maximum adjacent a part of said convexly curved cutting region of the cutting table, the rearward extent decreasing as the substrate extends away from said part of cutting region to a second region of the peripheral edge of the cutting table.

4. A cutter according to claim 3, wherein the rearward extent of the outer surface of said portion of the substrate decreases smoothly as it extends away from said part of the cutting region where it is a maximum.

5. A cutter according to claim 4, wherein the rearward extent of the outer surface of said portion of the substrate decreases substantially linearly as it extends away from said part of the cutting region.

6. A cutter according to claim 3, wherein said region of minimum rearward extent is diametrically opposite said part of the cutting region.

7. A cutter according to claim 1, wherein the substrate comprises a substantially unitary body of said less hard material to which the cutting table is bonded.

8. A cutter according to claim 1, wherein the substrate comprises a first portion to which the cutting table is bonded, said first portion being in turn bonded to a second, carrier portion.

9. A cutter according to claim 1, wherein the substrate is generally cylindrical in form, except for said portion of increasing lateral extent.

10. A cutter according to claim 9, wherein the substrate is of generally circular cross-section.

11. A cutter according to claim 1, wherein said portion of the substrate of increasing lateral extent is generally frusto-conical in shape.

12. A cutter according to claim 11, wherein the substrate is generally cylindrical and the variation in rearward extent of the outer surface of the frusto-conical portion is effected by the axis of the frusto-conical portion being offset from the central axis of the rest of the substrate.

13. A cutter according to claim 12, wherein the axis of the frusto-conical portion is parallel to, and spaced from, the axis of the rest of the substrate.

14. A cutter according to claim 12, wherein the axis of the frusto-conical portion is inclined with respect to said axis.

15. A cutter according to claim 11, wherein the angle of the frusto-conical portion of the substrate, and the offset of its axis, are so selected that the rearward extent of the outer surface of said frusto-conical portion is substantially zero in one region of the peripheral edge of the cutting table.

16. A cutter according to claim 1, wherein the peripheral edge of the cutting table is chamfered.

17. A cutter according to claim 16, wherein the chamfered peripheral edge of the cutting table blends substantially smoothly with the adjacent surface of the laterally increased portion of the substrate.

* * * * *